US005842099A

United States Patent [19]

Aslam et al.

[11] Patent Number: 5,842,099

[45] Date of Patent: Nov. 24, 1998

[54] APPLICATION OF CLEAR MARKING PARTICLES TO IMAGES WHERE THE MARKING PARTICLE COVERAGE IS UNIFORMLY DECREASED TOWARDS THE EDGES OF THE RECEIVER MEMBER

[75] Inventors: Muhammed Aslam, Rochester; Robert D. Bobo, Ontario; Dennis R. Kamp, Churville; Jerry E. Livadas, Webster, all of N.Y.

[73] Assignee: Eastman Kodak Company, Rochester, N.Y.

[21] Appl. No.: 992,746

[22] Filed: Dec. 17, 1997

[51] Int. Cl.[6] ..... G03G 15/09; G03G 15/16

[52] U.S. Cl. ..... 399/324; 399/341; 430/126

[58] Field of Search ..... 399/324, 325, 399/223, 231, 341; 430/126, 124, 98, 99

[56] References Cited

U.S. PATENT DOCUMENTS

| | | | |
|---|---|---|---|
| 4,082,681 | 4/1978 | Takayama et al. . | |
| 4,100,087 | 7/1978 | Takayama et al. . | |
| 4,108,786 | 8/1978 | Takayama et al. . | |
| 4,264,698 | 4/1981 | Takayama et al. . | |
| 4,510,225 | 4/1985 | Kuehnle et al. . | |
| 4,599,293 | 7/1986 | Eckell et al. . | |
| 4,833,059 | 5/1989 | Tomura et al. . | |
| 4,927,727 | 5/1990 | Rimai et al. . | |
| 4,968,578 | 11/1990 | Light et al. . | |
| 5,089,363 | 2/1992 | Rimai et al. . | |
| 5,102,767 | 4/1992 | Chowdry et al. | 430/126 |
| 5,104,765 | 4/1992 | Chowdry et al. | 430/126 |
| 5,130,219 | 7/1992 | Mori et al. . | |
| 5,142,337 | 8/1992 | Karidis et al. . | |
| 5,143,812 | 9/1992 | Mori et al. . | |
| 5,184,183 | 2/1993 | Karidis et al. . | |
| 5,256,507 | 10/1993 | Aslam et al. . | |
| 5,339,146 | 8/1994 | Aslam et al. . | |
| 5,339,148 | 8/1994 | Johnson et al. . | |
| 5,364,722 | 11/1994 | Tanikawa et al. . | |
| 5,392,104 | 2/1995 | Johnson . | |
| 5,539,506 | 7/1996 | Bean et al. . | |

FOREIGN PATENT DOCUMENTS

| | | |
|---|---|---|
| 810482 | 12/1997 | European Pat. Off. . |

*Primary Examiner*—R. L. Moses
*Attorney, Agent, or Firm*—Lawrence P. Kessler

[57] ABSTRACT

A reproduction apparatus utilizing clear marking particles in the development of an image, the clear marking particles being laid down so as to prevent offset upon fusing of an image to a receiver member. The reproduction apparatus is disclosed as including a dielectric member adapted to have latent images formed thereon. A development station, is provided including a plurality of developer units respectively containing marking particles of different colors, at least one developer unit containing black marking particles and another developer unit containing clear marking particles. The development station selectively develops latent images with marking particles from the developer units respectively. A transfer station serves to transfer developed marking particle images to a receiver member, and a fuser assembly fuses a marking particle image on a receiver member. The developing station is controlled such that the developer unit for applying clear marking particles is selectively activated to apply clear marking particles to a receiver member, the clear marking particles uniformly decreasing toward the edges of the receiver member.

19 Claims, 4 Drawing Sheets

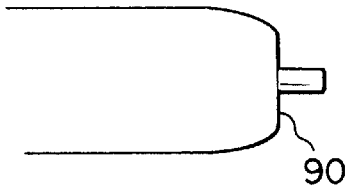
FIG. 6
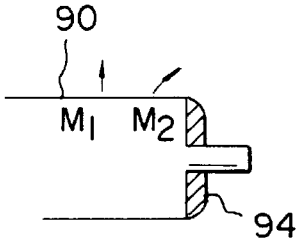
FIG. 7
FIG. 8
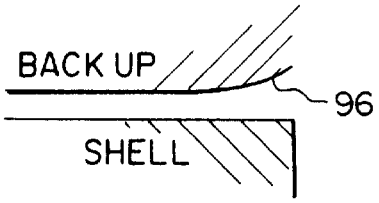
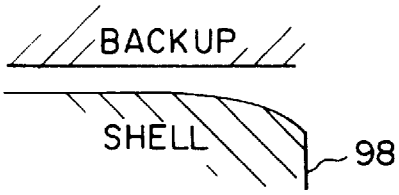
FIG. 9
FIG. 10
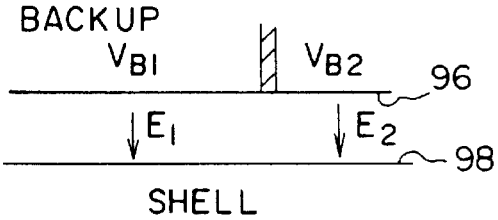
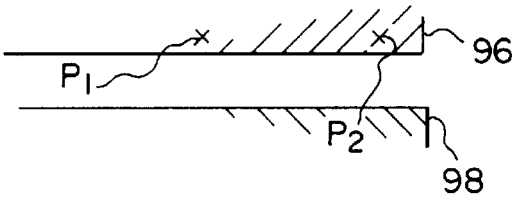
FIG. 11
FIG. 12
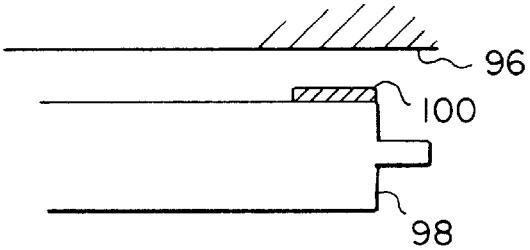

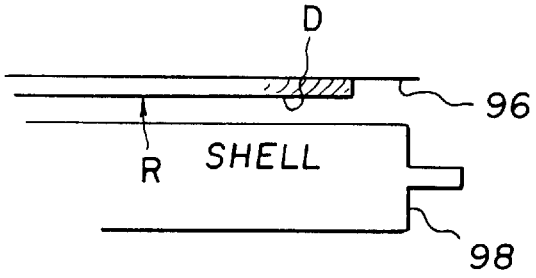
FIG. 13
FIG. 14
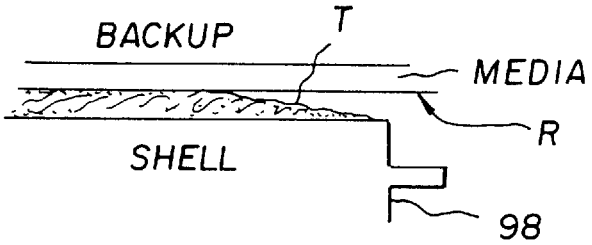
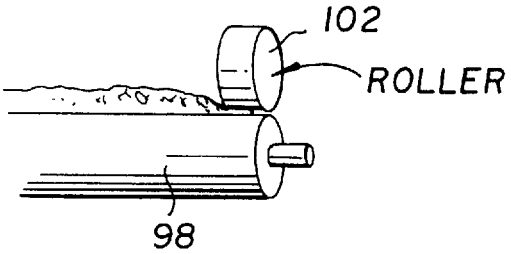
FIG. 15
FIG. 16
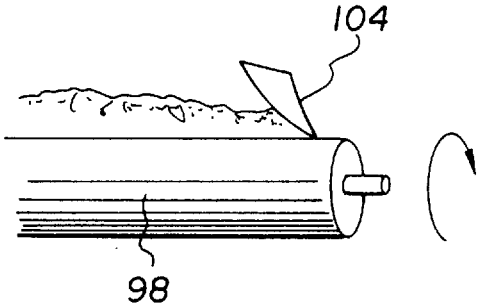
FIG. 17
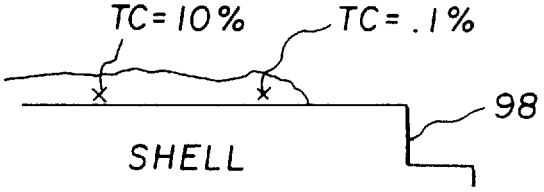

APPLICATION OF CLEAR MARKING PARTICLES TO IMAGES WHERE THE MARKING PARTICLE COVERAGE IS UNIFORMLY DECREASED TOWARDS THE EDGES OF THE RECEIVER MEMBER

CROSS-REFERENCE TO RELATED APPLICATIONS

U.S. patent application Ser. No. 08/992,872, filed Dec. 17, 1997, entitled "REPRODUCTION APPARATUS PROVIDING SELECTABLE IMAGE QUALITY AND GLOSS" in the name of Muhammed Aslam et al.

U.S. patent application Ser. No. 08/992,057, filed Dec. 17, 1997, entitled "BELT FUSING ACCESSORY WITH SELECTABLE FUSED IMAGE GLOSS" in the name of Muhammed Aslam et al.

U.S. patent application Ser. No. 08/992,643, filed Dec. 17, 1997, entitled "BELT FUSER APPARATUS FOR PREVENTING LINE ART TYPE MARKING PARTICLE OFFSET" in the name of Muhammed Aslam et al.

U.S. patent application Ser. No. 08/992,058, filed Dec. 17, 1997, entitled "APPLICATION OF CLEAR TONER DEVELOPED NEGATIVE TO THE IMAGE IN AN ELECTROPHOTOGRAPHIC PROCESS TO ELIMINATE IMAGE RELIEF AND DIFFERENTIAL GLOSS ARTIFACTS" in the name of William J. Staudenmayer et al.

U.S. patent application Ser. No. 08/992,060, filed Dec. 17, 1997, entitled "COOLING AND REUSING THE HEAT TO PREHEAT THE FUSING WEB IN A BELT FUSER" in the name of Muhammed Aslam et al.

U.S. patent application Ser. No. 08/992,056, filed Dec. 17, 1997, entitled "MECHANISM FOR TRACKING THE BELT OF A BELT FUSER" in the name of Muhammed Aslam et al.

U.S. patent application Ser. No. 08/992,059, filed Dec. 17, 1997, entitled "A COLLAPSIBLE CUSTOMER REPLACEABLE BELT FUSER ASSEMBLY DESIGNED FOR ACCESSIBILITY, SERVICEABILITY, AND FUSING BELT REPLACEMENT" in the name of Muhammed Aslam et al.

U.S. patent application Ser. No. 08/992,745, filed Dec. 17, 1997, entitled "APPARATUS FOR PACKAGING AND INSTALLATION OF A FUSING BELT" in the name of Muhammed Aslam et al.

FIELD OF THE INVENTION

This invention is directed in general to reproduction apparatus where clear marking particles are applied to images, and more particularly a reproduction apparatus where the application of clear marking particles is uniformly decreased toward the edges of the receiver member to prevent marking particle offset upon fusing of the image to the receiver member.

BACKGROUND OF THE INVENTION

Typical commercial reproduction apparatus include electrostatographic process copier/duplicators or printers, inkjet printers, and thermal printers. With such reproduction apparatus, a colorant such as pigmented marking particles, ink, or dye material (hereinafter referred to commonly as marking particles) are utilized to develop an image, of information to be reproduced, on a support member for transfer to a receiver member, or directly onto a receiver member. The receiver member bearing the marking particle image is transported through a fuser device where the image is fixed (fused) to the receiver member, for example, by heat and pressure to form a permanent reproduction thereon. While the fuser device is typically integral with the reproduction apparatus, it may also be an independent piece of equipment, generally referred to as an off line fuser. Off line fusers, being a device devoted to a single task, have the ability to have their operating parameters optimized to perform the fusing function.

Certain reproduction apparatus have been designed to produce multi-color copies. In such reproduction apparatus, multiple color separation images are respectfully developed with complimentary colored marking particles, in superposition on a receiver member. It has been found that fixing of multi-color marking particle images to a receiver member requires substantially different operating parameters than fixing standard black marking particle images to a receiver member. Moreover, the respective operating parameters may in fact be in contradistinction. That is, multi-color images require a high degree of glossiness for a full, rich depth of color reproduction; on the other hand, since glossiness for black marking particle images may significantly impair legibility, a matte finish is preferred.

It is known that the glossiness of a marking particle image is, at least in part, dependent upon the marking particle melting characteristics in the fixing process. In general, the fixing apparatus serves to soften or at least partially melt the marking particles, enabling the marking particles to permeate into the fibers of the receiver member so that the marking particles are fixed to the receiver member to give a glossy image reproduction. For example, the fixing apparatus may include a heated roller which contacts the marking particles and the receiver member. With multi-color marking particle images, the multiple color marking particle images are respectively melted and fixed by the heated roller. If the color marking particle images are not sufficiently melted, light scattering cavities may occur in the copy which degrades the color reproduction. Moreover, if the marking particles on the receiver member do not have a mirror-like surface, incident light is reflected by diffusion from the marking particle surface and is not admitted into the marking particle layers, making the colors on the receiver member appear dark and cloudy. Therefore, low melting point marking particles are used. They yield few cavities and a hard flat surface so as to give glossy and vivid colors in the reproduction.

Low melting point marking particles are subject to increased image offset to the heating roller. This can produce undesirable defects in the reproduction or subsequent reproductions. Although image offset can be reduced by application of fuser oil to the heating roller, the use of such oil introduces further complications into the fusing system, such as handling of the oil and making sure that the layer of oil on the roller is uniform for uniform heat application. Alternatively, a mechanical arrangement for reducing image offset, without the need for fuser oil, has been found. Such mechanical arrangement, as shown for example in U.S. Pat. No. 5,256,507 (issued Oct. 26, 1993, in the name of Aslam et al), provides an elongated web which is heated to melt the marking particles and then cooled to cool the particles and facilitate ready separation of the receiver member with the marking particle image fixed thereto from the elongated web. The nature of operation of the elongated web arrangement also serves to increase the glossiness of the fixed marking particle image. As a result, such arrangement is particularly useful for multi-color image fusing.

As noted in the above referenced copending U.S. patent application Ser. No. 08/992,872, it has been found that applying an overcoat of clear marking particles provides significant advantages in the reproduction of information on receiver members. The clear marking particles can be used for many purposes, such as controlling image gloss, preventing image offset upon fusing, and protecting a finished reproduction. The is, however, still some tendency, under certain conditions, for the marking particles of the image to offset to the fuser roller during the fusing operation.

SUMMARY OF THE INVENTION

In view of the above, this invention is directed to a reproduction apparatus where clear marking particles are applied to the reproduced image, the application of clear marking particles being uniformly decreased toward the edges of the receiver member to prevent marking particle offset upon fusing of the image to the receiver member. The reproduction apparatus, as disclosed, a dielectric member adapted to have latent images formed thereon. A development station, is provided including a plurality of developer units respectively containing marking particles of different colors, at least one developer unit containing black marking particles and another developer unit containing clear marking particles. The development station selectively develops latent images with marking particles from the developer units respectively. A transfer station serves to transfer developed marking particle images to a receiver member, and a fuser assembly fuses a marking particle image on a receiver member. The developing station is controlled such that the developer unit for applying clear marking particles is selectively activated to apply clear marking particles to a receiver member, the clear marking particles uniformly decreasing toward the edges of the receiver member.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which:

FIG. 6 is a side elevational view, on an enlarged scale, of a portion of the developing unit showing physically altering the shape of the magnets, for decreasing marking particle laydown such that coverage uniformly decreases towards the edges of the receiver member according to this invention;

FIG. 7 is a side elevational view, on an enlarged scale, of a portion of the developing unit showing the provision of an end keeper which acts to bend the fringe fields, for decreasing marking particle laydown such that coverage uniformly decreases towards the edges of the receiver member according to this invention;

FIG. 8 is a side elevational view, on an enlarged scale, of a portion of the developing unit showing the provision of tapering the backup roller, for decreasing marking particle laydown such that coverage uniformly decreases towards the edges of the receiver member according to this invention;

FIG. 9 is a side elevational view, on an enlarged scale, of a portion of the developing unit showing the provision of tapering the shell, for decreasing marking particle laydown such that coverage uniformly decreases towards the edges of the receiver member according to this invention;

FIG. 10 is a side elevational view, on an enlarged scale, of a portion of the developing unit showing the provision of segmented electrodes for the developing shell or the backup electrode, for decreasing marking particle laydown such that coverage uniformly decreases towards the edges of the receiver member according to this invention;

FIG. 11 is a side elevational view, on an enlarged scale, of a portion of the developing unit showing the provision of continuously variable resistivity electrodes for the developing shell or the backup electrode, for decreasing marking particle laydown such that coverage uniformly decreases towards the edges of the receiver member according to this invention;

FIG. 12 is a side elevational view, on an enlarged scale, of a portion of the developing unit showing the provision of dielectric coatings or tapes on the developing shell or the backup electrode, for decreasing marking particle laydown such that coverage uniformly decreases towards the edges of the receiver member according to this invention;

FIG. 13 is a side elevational view, on an enlarged scale, of a portion of the developing unit showing the provision of variable dielectric properties at the edges of the receiver members, for decreasing marking particle laydown such that coverage uniformly decreases towards the edges of the receiver member according to this invention;

FIG. 14 is a side elevational view, on an enlarged scale, of a portion of the developing unit showing the provision of varying the skive gap to reduce or control the flow of marking particles at the edges, for decreasing marking particle laydown such that coverage uniformly decreases towards the edges of the receiver member according to this invention;

FIGS. 15 and 16 are respective side elevational views, on an enlarged scale, of a portion of the developing unit showing the provision of specialized mechanisms to treat the edges by removing marking particles, for decreasing marking particle laydown such that coverage uniformly decreases towards the edges of the receiver member according to this invention; and FIG. 17 is a side elevational view, on an enlarged scale, of a portion of the developing unit showing depleting marking particle concentration at the ends of the shell, for decreasing marking particle laydown such that coverage uniformly decreases towards the edges of the receiver member according to this invention.

DETAILED DESCRIPTION OF THE INVENTION

Figure 1:
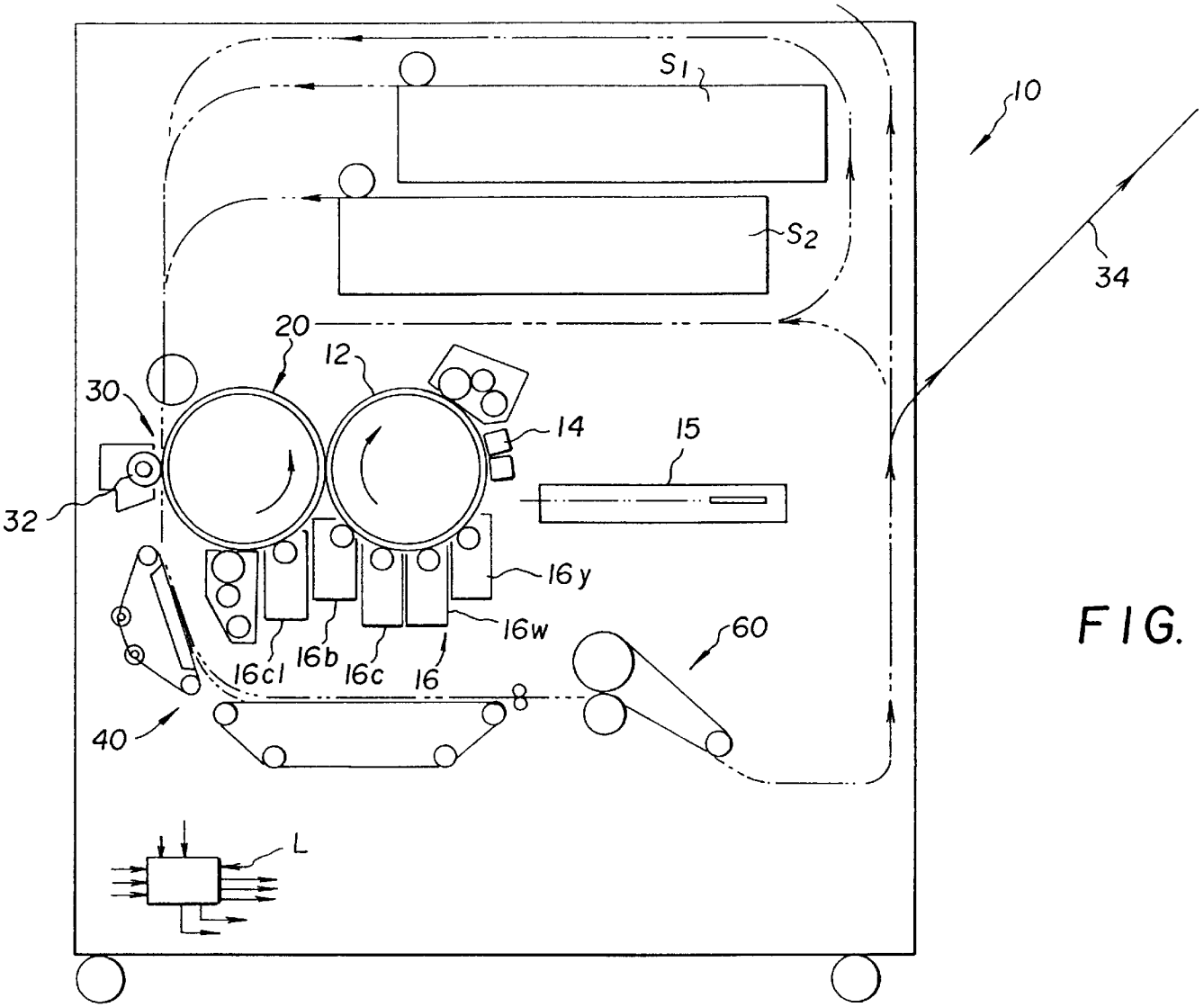
FIG. 1 is a front elevational view of an electrostatographic reproduction apparatus, eliminating image relief and differential gloss by application of clear marking particles, according to this invention.

Referring now to the accompanying drawings, an electrostatographic reproduction apparatus, designated generally by the numeral 10, is shown in FIG. 1. The reproduction apparatus 10 includes a primary image forming dielectric member, for example, a drum 12 having a photoconductive surface, upon which a pigmented marking particle image, or series of different color marking particle images, is formed. In order to form images, when the photoconductive drum 12 is rotated in the direction of the arrow associated therewith, the photoconductive surface of drum is uniformly charged, and then exposed imagewise by, for example, a laser 15 or light emitting diode (LED) array, to create a corresponding latent electrostatic image. The latent electrostatic image is developed by a application of pigmented marking particles to the image bearing drum 12 by a development station 16. In the embodiment of the reproduction apparatus 10 as shown, there are five developing units, each unit having particular different color marking particles associated respectively therewith. Specifically, developing unit 16*y* contains yellow marking particles, developing unit 16*m* contains magenta marking particles, developing unit 16*c* contains cyan marking particles, and developing unit 16*b* contains black marking particles. Of course, other color marking particles (e.g. red, green, blue, etc.) may be used in the particular developing units depending upon the overall arrangement of the development station 16 and operational characteristics of the color development scheme for the reproduction apparatus 10. Additionally, a developing unit 16*cl* is provided, containing clear marking particles, which is utilized to aid in improving the quality and gloss of reproduced images, in the manner more fully described in the copending U.S. patent application Ser. No. 08/992,872 filed Dec. 9, 1992, now U.S. Pat. No. 5,841,039, filed on even date herewith.

Each developer unit is separately activated for operative developing relation with drum 12 to apply different color marking particles respectively to a series of images carried on drum 12 to create a series of different color marking particle images. The developed marking particle image is transferred (or multiple marking particle images are transferred one after another in registration) to the outer surface of a secondary or intermediate image transfer member, for example, an intermediate transfer drum 20. Thereafter, the single marking particle image, or a multicolor image comprising multiple marking particle images respectively formed on the surface of the intermediate image transfer member drum 20, is transferred in a single step to a receiver member.

The receiver member is transported along a path (designated by chain-link lines) into a nip 30 between intermediate image transfer member drum 20 and a transfer backing member, for example a roller 32. The receiver member is delivered from a suitable receiver member supply (hopper $S_1$ or $S_2$) into nip 30 where it receives the marking particle image. The receiving member exits the nip 30, and is transported by transport mechanism 40 to a fuser assembly 60 where the marking particle image is tacked to the receiver member by application of heat and/or pressure. After tacking the image to the receiver member, the receiver member is selectively transported to return to the transfer nip 30 to have a second side (duplex) image transferred to such receiver member, to a remote output tray 34 for operator retrieval, or to an output accessory.

Appropriate sensors (not shown) of any well known type, such as mechanical, electrical, or optical for example, are utilized in the reproduction apparatus 10 to provide control signals for the apparatus. Such sensors are located along the receiver member travel path and are associated with the primary image forming member photoconductive drum 12, the intermediate image transfer member drum 20, the transfer backing member roller 32, and various image processing stations. As such, the sensors detect the location of a receiver member in its travel path, and the position of the primary image forming member photoconductive drum 12 in relation to the image forming processing stations, and respectively produce appropriate signals indicative thereof. Such signals are fed as input information to a logic and control unit L including a microprocessor, for example. Based on such signals and a suitable program for the microprocessor, the unit L produces signals to control the timing operation of the various electrographic process stations for carrying out the reproduction process. The production of a program for a number of commercially available microprocessors, which are suitable for use with the invention, is a conventional skill well understood in the art. The particular details of any such program would, of course, depend on the architecture of the designated microprocessor.

Under certain conditions for desired particular reproductions, as discussed in the copending U.S. patent application Ser. No.08/992,872 filed Dec. 9, 1992, now U.S. Pat. No. 5,841,039, during operation of the reproduction apparatus 10, first the developer unit 16*cl* lays down layer of clear marking particles on the intermediate transfer drum 20 corresponding to an area substantially equal to the area of a receiver member. Thereafter, color separation latent image charge patterns formed by the laser 15 on the drum 12 are developed with respective color marking particles and transferred in superposed registration to the intermediate transfer drum 20 (already bearing the clear marking particle layer). Then the combination marking particle image is transferred to a receiver member, such as a coated sheet of paper, delivered to the transfer nip 30 from the selected supply hopper. After transfer of the multi-color image with the clear overcoat to the coated paper, the transport mechanism 40 delivers the paper to the fusing device 60, where a gloss finish is imparted to the image.

Figure 2:
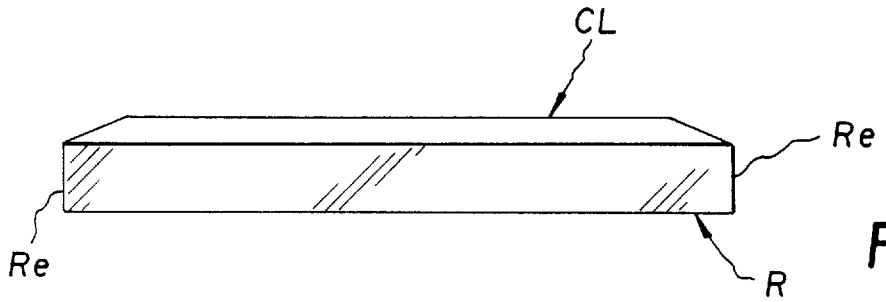
FIG. 2 is a view, in cross-section and on an enlarged scale, of a marking particle image bearing receiver member upon which a clear marking particle layer has been laid down, according to this invention.
Figure 3:
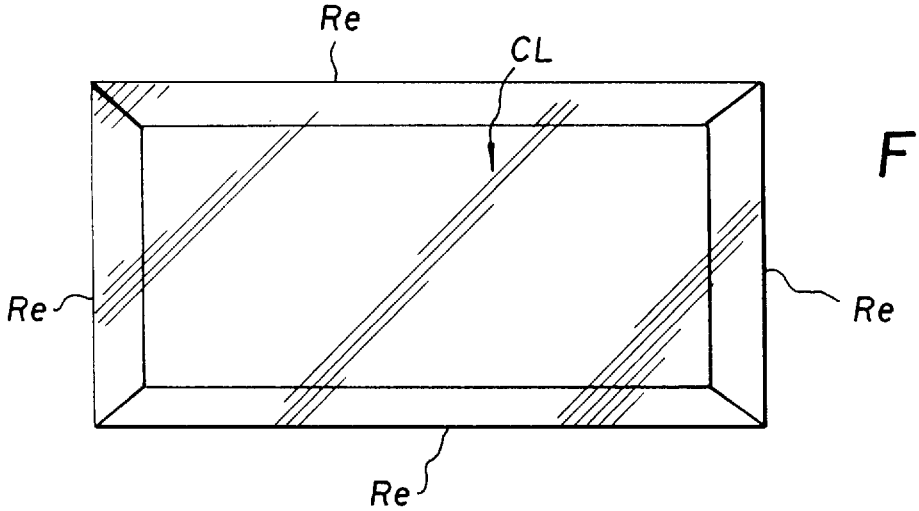
FIG. 3 is a top plan view of a marking particle image bearing receiver member upon which a clear marking particle layer has been laid down, according to this invention.

The clear marking particle layer forms an overcoat which will substantially reduce image relief, produces a more uniform gloss appearance, and protects the reproduced images from various keeping and handling hazards such as finger prints, scratches, water spills, color fades due to UV exposures, vinyl offsets, and many others. However, it has been noted that during the fusing process of such marking particle images, marking particle offset sometimes still occurs, particularly to the heated fusing roller near the edges of the receiver member. According to this invention, it is proposed that the lay down of the clear marking particles CL be affected such that the coverage uniformly decreases towards the edges $R_e$ of the receiver member R as shown in FIGS. 2 and 3. As a result, the marking particle offset problem is substantially eliminated, especially when the fusing member is a metal or plastic belt as described above.

Figure 4:
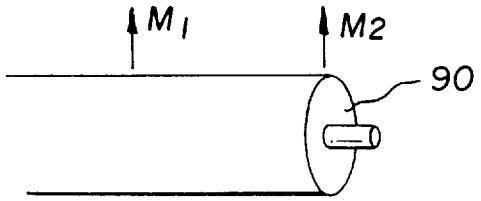
FIG. 4 is a side elevational view, on an enlarged scale, of a portion of the developing unit showing the provision of magnets with less strength at the ends thereof, for decreasing marking particle laydown such that coverage uniformly decreases towards the edges of the receiver member according to this invention.
Figure 5:
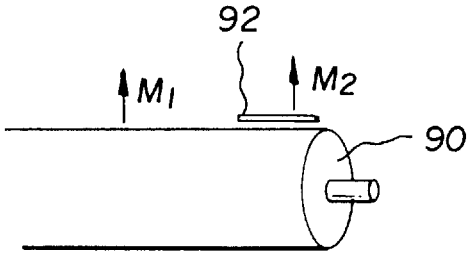
FIG. 5 is a side elevational view, on an enlarged scale, of a portion of the developing unit showing shielding constant strength magnets near their ends, for decreasing marking particle laydown such that coverage uniformly decreases towards the edges of the receiver member according to this invention.

The developing of solid areas with clear marking particles which taper from a maximum height on the receiver member to zero at the edges of the receiver member may be accomplished by shaping of the magnetic field, the development gap, or the electric field, or by selective depletion of the marking particles. In shaping the magnetic field, the strength of the magnets of the developing unit 16*cl* of the development station 16 are set so as to be less effective near the ends thereof. This condition may be produced by providing magnets with less strength at the ends thereof (see FIG. 4 where magnetic strength is indicated by the designators $M_1$ and $M_2$) as opposed to over the main body of the developing roller 90; or by providing a shield 92, for constant strength magnets of the developing roller 90, near their ends (see FIG. 5). Other mechanisms for shaping the magnetic field include physically altering the shape of the magnets of the developing roller 90 (see FIG. 6), or providing an end member 94 or keeper which acts to bend the magnetic fringe fields of the developing roller 90(see FIG. 7). On the other hand, shaping of the development gap can be effected by tapering the backup roller 96 (see FIG. 8) or the shell 98 (see FIG. 9) of the developing unit.

There are also various ways for shaping of the electric field. For example, either the developing shell 98 or the backup electrode (roller) may include segmented electrodes (see FIG. 10 where the electric field is indicated by the designators $E_1$, $E_2$) or continuously variable resistivity electrodes (see FIG. 11 where the resistivity is indicated by the designators $P_1$, $P_2$). Other mechanisms for shaping the electric field include dielectric coatings or tapes 100, etc., on the developing shell 98 (see FIG. 12) or on the backup electrode 96, or by providing variable dielectric properties D at the edges of the receiver members R (see FIG. 13).

In the technique of developing of solid areas with clear marking particles which taper from a maximum height to zero at the edges of the receiver member by selective depletion of the marking particles, such depletion may be produced by varying the skive gap (decrease toward the edges) to actively reduce or control the flow of marking particles at the edges (see FIG. 14 where marking particle flow is indicated by the designator T), or by providing specialized mechanisms to treat the edges by actively removing marking particles (see roller 102 in FIG. 15, or skive 104 in FIG. 16). Alternatively, some zone of "pre-development" may be provided internal to the developing unit to deplete marking particle concentration at the ends of the shell (see FIG. 17 where the marking particle concentration is indicated by the designators TC).

The invention has been described in detail with particular reference to certain preferred embodiments thereof, but it will be understood that variations and modifications can be effected within the spirit and scope of the invention.

What is claimed is:

1. A reproduction apparatus utilizing clear marking particles in the development of an image, said clear marking particles being laid down so as to prevent offset upon fusing of an image to a receiver member, said reproduction apparatus comprising:

a dielectric member adapted to have latent images formed thereon;

a development station, including a plurality of developer units respectively containing marking particles of different colors, at least one developer unit containing black marking particles and another developer unit containing clear marking particles, said development station selectively developing latent images with marking particles from said developer units respectively;

a transfer station for transferring developed marking particle images from said dielectric member to a receiver member;

a fuser assembly for fusing a marking particle image on a receiver member; and control means for selectively activating said developer unit for applying clear marking particles to a receiver member, said clear marking particles uniformly decreasing toward the edges of said receiver member.

2. The reproduction apparatus of claim 1 wherein said development station is of the magnetic brush type including a plurality of magnets, and said control means includes means for shaping of the magnetic field in said development station.

3. The reproduction apparatus of claim 2 wherein said magnets have less strength adjacent to their ends.

4. The reproduction apparatus of claim 2 wherein said magnets are of constant strength and have shielding near the ends thereof.

5. The reproduction apparatus of claim 2 wherein said magnets are physically configured to alter the magnetic fields adjacent to the ends thereof.

6. The reproduction apparatus of claim 1 wherein said development station is of the magnetic brush type including a development gap defined between a shell and a backup member, and said control means includes means for shaping of the development gap.

7. The reproduction apparatus of claim 6 wherein said shell is tapered adjacent to the ends thereof.

8. The reproduction apparatus of claim 6 wherein said backup member is tapered adjacent to the ends thereof.

9. The reproduction apparatus of claim 1 wherein said development station is of the magnetic brush type including a development gap defined between a shell and a backup member, and said control means includes means for shaping the electric field of said development station.

10. The reproduction apparatus of claim 9 wherein said shell includes segmented electrodes.

11. The reproduction apparatus of claim 9 wherein said shell includes continuously variable resistivity electrodes.

12. The reproduction apparatus of claim 9 wherein said backup member includes segmented electrodes.

13. The reproduction apparatus of claim 9 wherein said backup member includes continuously variable resistivity electrodes.

14. The reproduction apparatus of claim 1 wherein said development station is of the magnetic brush type including a development gap defined between a shell and a backup member, and said control means includes means for selective depletion of the marking particles in said development gap.

15. The reproduction apparatus of claim 14 wherein said means for selective depletion of the marking particles includes means for actively removing marking particles from said shell adjacent to the ends thereof.

16. The reproduction apparatus of claim 15 wherein said marking particle removing means includes a skive.

17. The reproduction apparatus of claim 15 wherein said marking particle removing means includes a pickup mechanism.

18. The reproduction apparatus of claim 14 wherein said means for selective depletion of the marking particles includes means for depleting marking particle concentration adjacent to the ends of said shell.

19. In a reproduction apparatus, utilizing clear marking particles in the development of an image, a method for laying down clear marking particles so as to prevent offset upon fusing of an image to a receiver member, said method comprising the steps of:

forming a latent image on a dielectric member adapted to have latent images formed thereon;

with a development station, including a plurality of developer units respectively containing marking particles of different colors, at least one developer unit containing black marking particles and another developer unit containing clear marking particles, selectively developing latent images on said dielectric member with marking particles from said developer units respectively;

laying down clear marking particles over an area corresponding to a receiver member, such that said clear marking particles uniformly decrease toward the edges of such area;

transferring developed marking particle images to a receiver member; and fusing the transferred marking particle images on a receiver member.

* * * * *